US012631022B2

(12) United States Patent
Jung

(10) Patent No.: US 12,631,022 B2
(45) Date of Patent: May 19, 2026

(54) SANDWICH PANEL

(71) Applicant: KUKMIN ENTERPRISE CO., LTD, Ansan-si (KR)

(72) Inventor: Je Sung Jung, Suwon-si (KR)

(73) Assignee: KUKMIN ENTERPRISE CO., LTD, Ansan-si (KR)

( * ) Notice: Subject to any disclaimer, the term of this patent is extended or adjusted under 35 U.S.C. 154(b) by 0 days.

(21) Appl. No.: 18/712,876

(22) PCT Filed: Apr. 27, 2023

(86) PCT No.: PCT/KR2023/005811

§ 371 (c)(1),
(2) Date: May 23, 2024

(87) PCT Pub. No.: WO2023/211224

PCT Pub. Date: Nov. 2, 2023

(65) Prior Publication Data

US 2025/0034861 A1 Jan. 30, 2025

(30) Foreign Application Priority Data

Apr. 27, 2022 (KR) ..... 10-2022-0052256
Jul. 18, 2022 (KR) ..... 10-2022-0087980

(51) Int. Cl.
*E04B 1/94* (2006.01)
*E04F 13/08* (2006.01)

(52) U.S. Cl.
CPC ..... *E04B 1/948* (2013.01); *E04B 1/942* (2013.01); *E04B 1/947* (2013.01);
(Continued)

(58) Field of Classification Search
CPC ..... E04F 2201/043; E04F 13/0876; E04F 13/0889; E04F 13/12; E04B 1/6129;
(Continued)

(56) References Cited

U.S. PATENT DOCUMENTS 3,760,548 A * 9/1973 Sauer ..... E04B 1/6812 52/592.1
5,293,728 A * 3/1994 Christopher ..... E04C 2/292 52/590.3

(Continued)

FOREIGN PATENT DOCUMENTS

JP 2008-121213 5/2008
JP 2012-233305 11/2012

(Continued)

*Primary Examiner* — Gisele D Ford
(74) *Attorney, Agent, or Firm* — LEX IP MEISTER, PLLC

(57) ABSTRACT

The present disclosure relates to a sandwich panel and includes a core, and an exterior panel disposed at one side and the other side of the core respectively. The exterior panel includes a body in contact with the core, a hooking portion exhibiting elastic force toward a first direction perpendicular to one side of the body at one end of the body, and a groove portion exhibiting elastic force toward a second direction perpendicular to one side of the body at the other end of the body and having an accommodating groove. An inflow protruding portion filled with the core is formed at the groove portion, and an inflow groove is formed by the omission of the core at the hooking portion, wherein thermal energy applied to the body is transferred to the hooking portion and the groove portion, and the hooking portion and the groove portion are deformable by the thermal energy.

16 Claims, 16 Drawing Sheets

(52) U.S. Cl.
CPC ... *E04F 13/0876* (2013.01); *E04F 2201/0115* (2013.01); *E04F 2201/023* (2013.01); *E04F 2201/043* (2013.01)

(58) Field of Classification Search
CPC ..... E04B 1/6116; E04C 2/296; E04C 2/292; E04D 3/368; E04D 3/355; E04D 3/352
See application file for complete search history.

(56) References Cited

U.S. PATENT DOCUMENTS 5,448,865 A * 9/1995 Palmersten ..... E04H 5/10 52/592.1
6,122,879 A * 9/2000 Montes ..... E04F 13/0876 52/592.4
6,314,701 B1 * 11/2001 Meyerson ..... E04C 2/292 52/592.1
8,141,325 B2 3/2012 Cheng et al.
2009/0025335 A1 * 1/2009 Flynn ..... E04D 3/355 52/794.1
2012/0231231 A1 * 9/2012 Curtin ..... E04C 2/292 428/192
2018/0216352 A1 * 8/2018 Hensiek ..... E04F 13/0878
2023/0003021 A1 * 1/2023 Barry ..... B32B 3/08
2024/0141646 A1 * 5/2024 Repolusk ..... E04C 2/292

FOREIGN PATENT DOCUMENTS

KR 10-1995-0704582 11/1995
KR 20-0383481 5/2005
KR 101597681 2/2016
KR 10-1601198 3/2016
KR 101697701 1/2017
KR 10-2027382 10/2019
KR 10-2020-0021229 2/2020
KR 102083456 3/2020
KR 10-2020-0099244 8/2020
KR 10-2157055 9/2020
KR 102556285 7/2023

* cited by examiner

[FIG. 1]
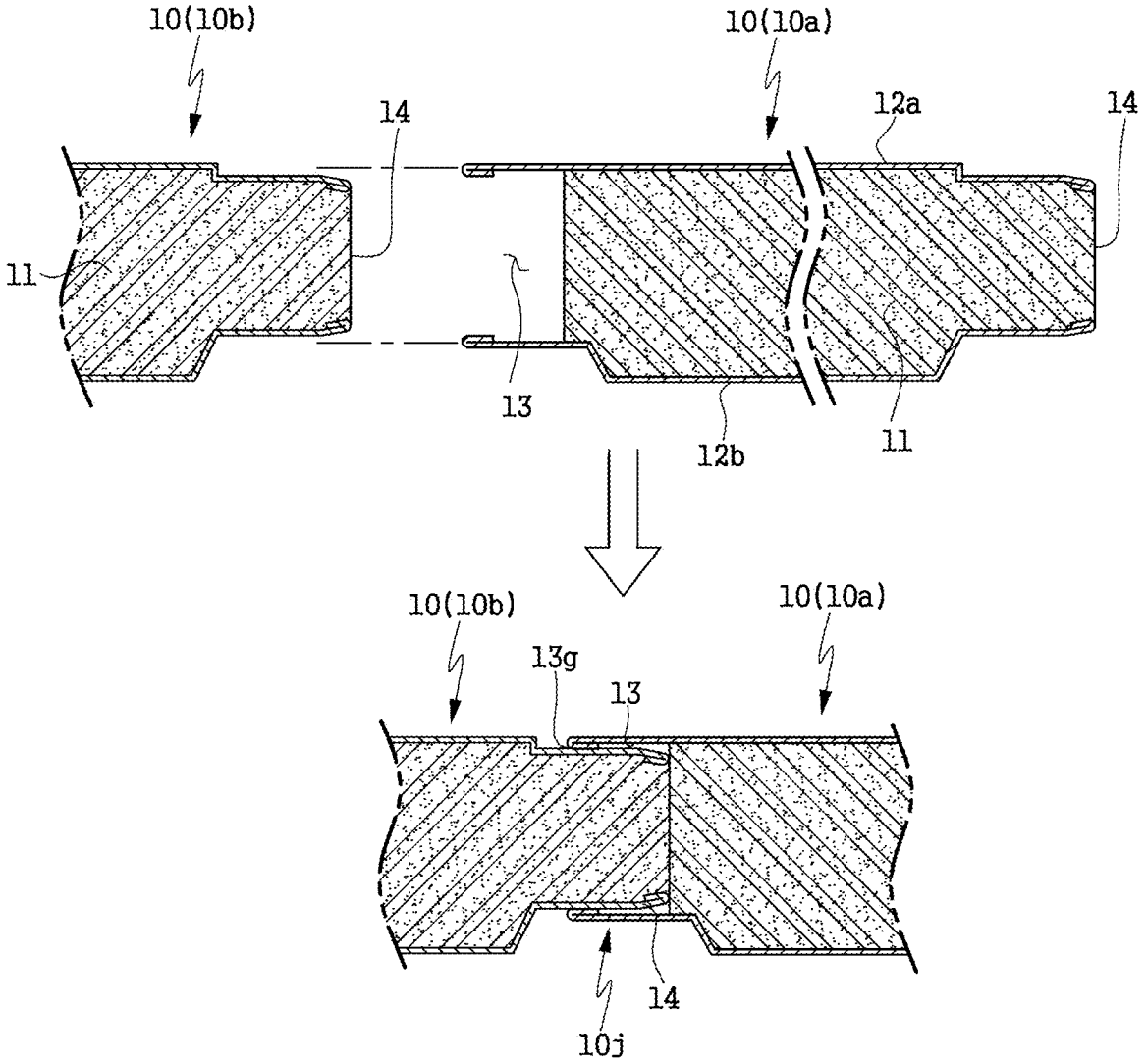

[FIG. 2]
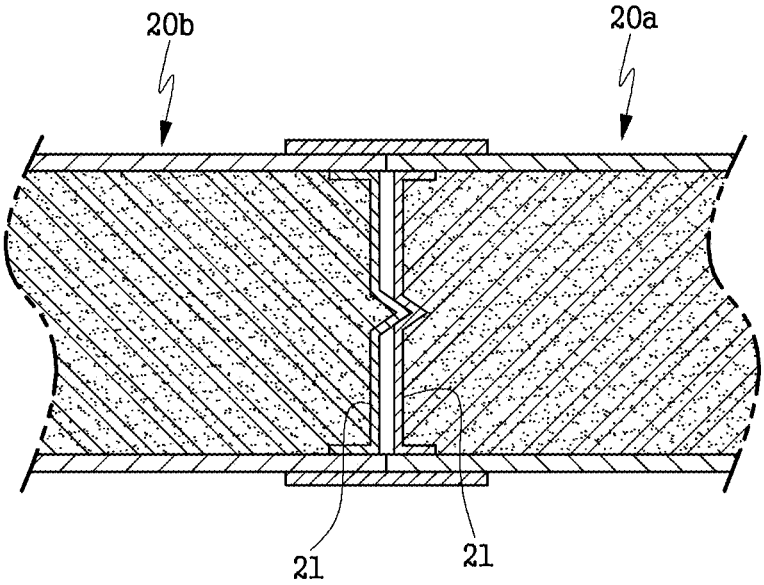
[FIG. 3]
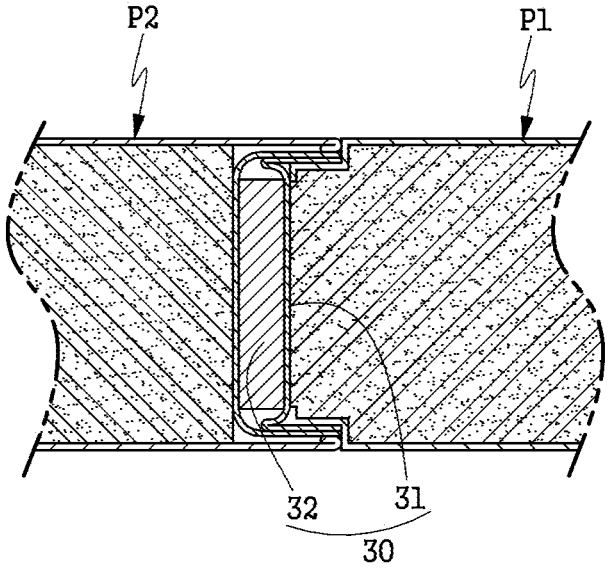

[FIG. 4]
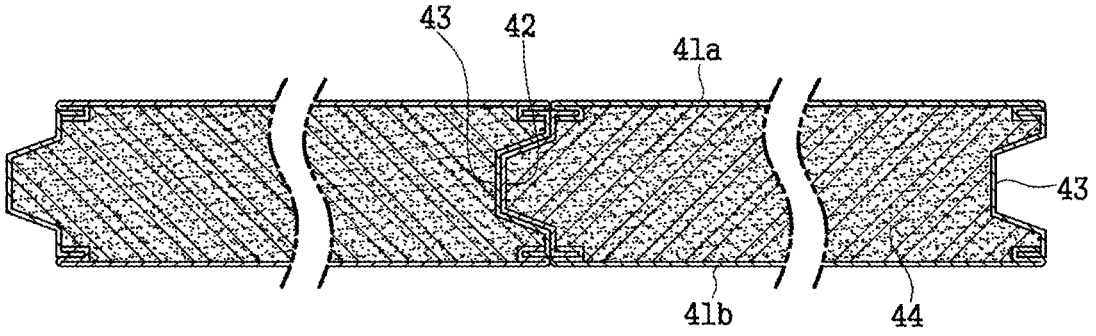

[FIG. 5]
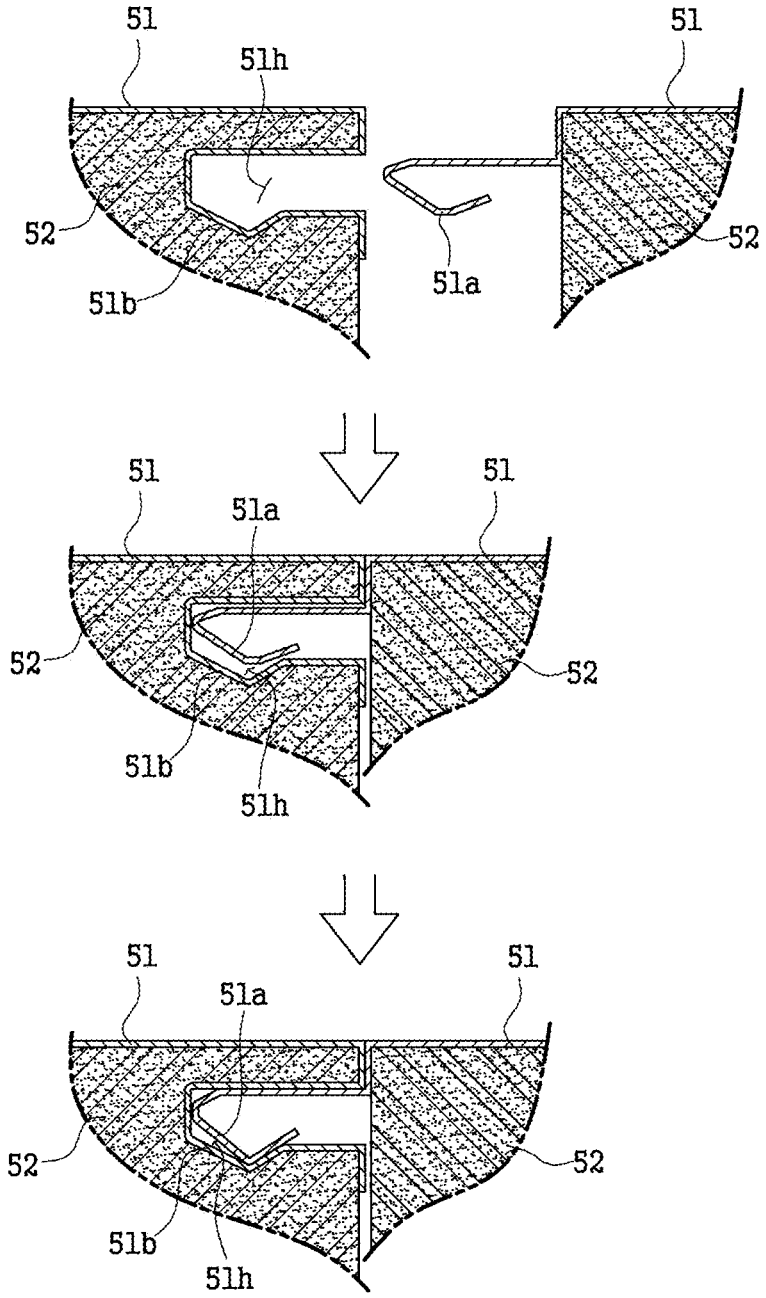

[FIG. 6]
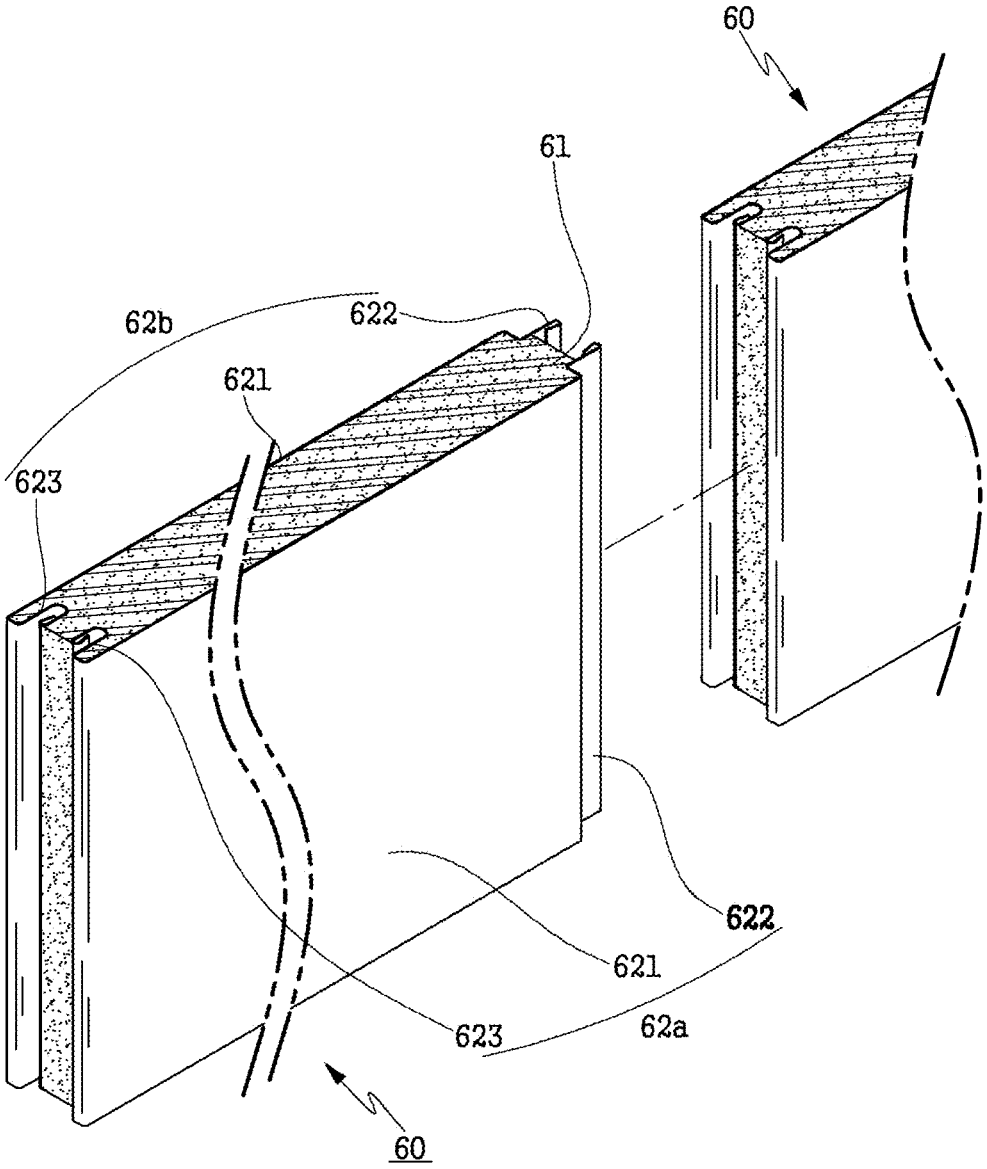

[FIG. 7]
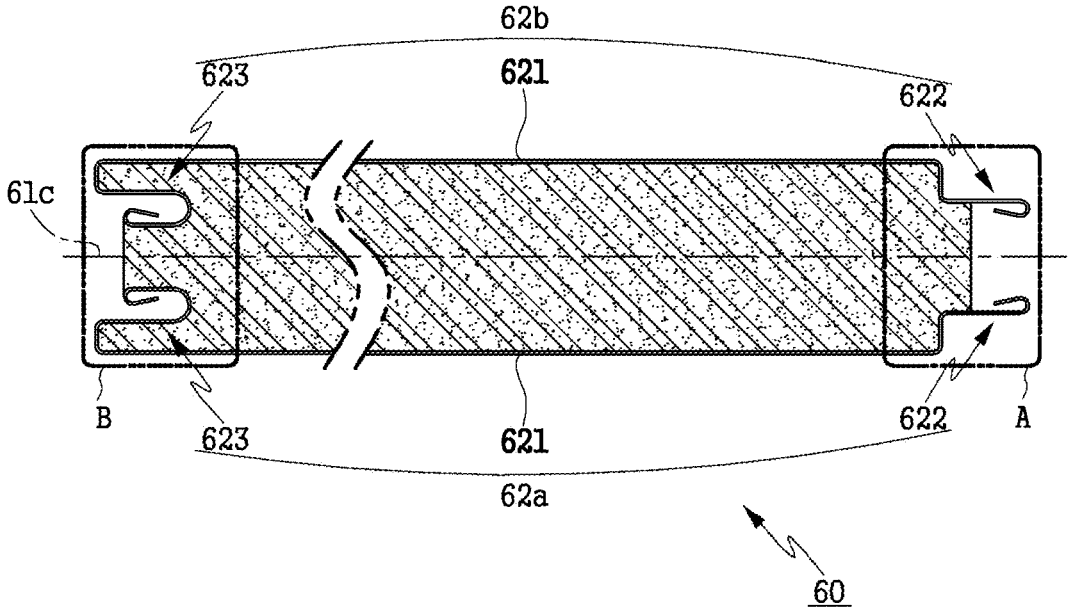

[FIG. 8]
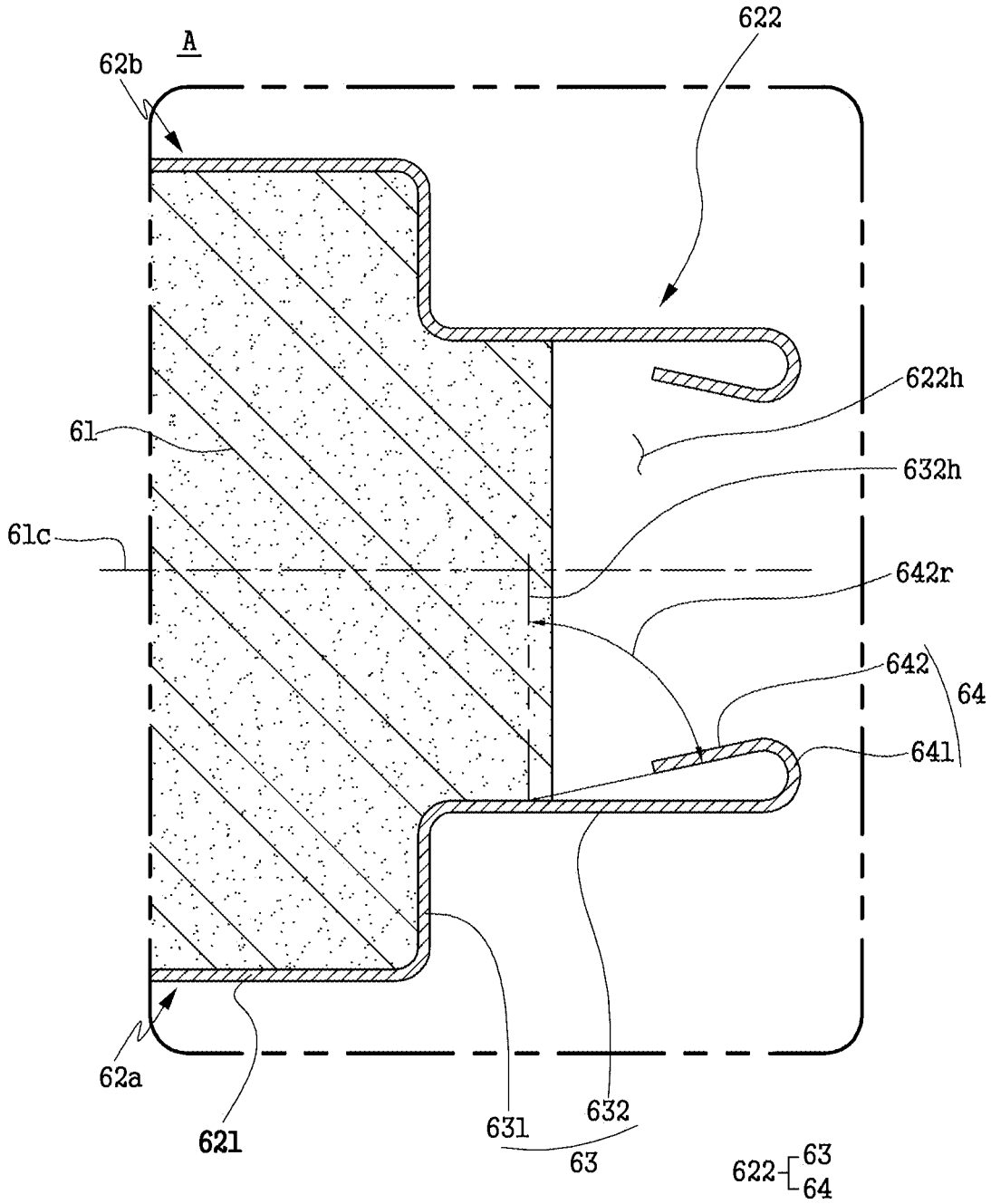

[FIG. 9]
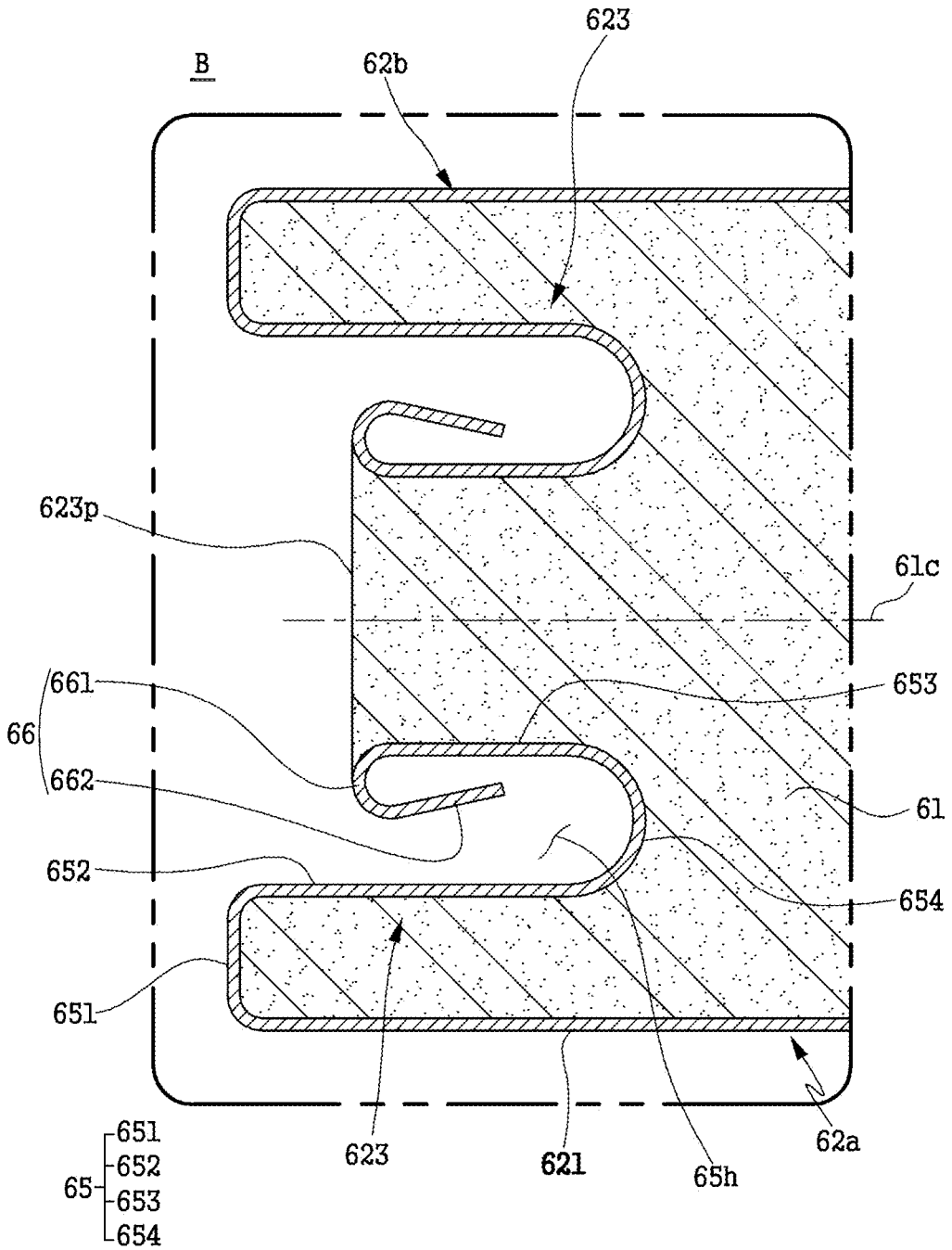

[FIG. 10]
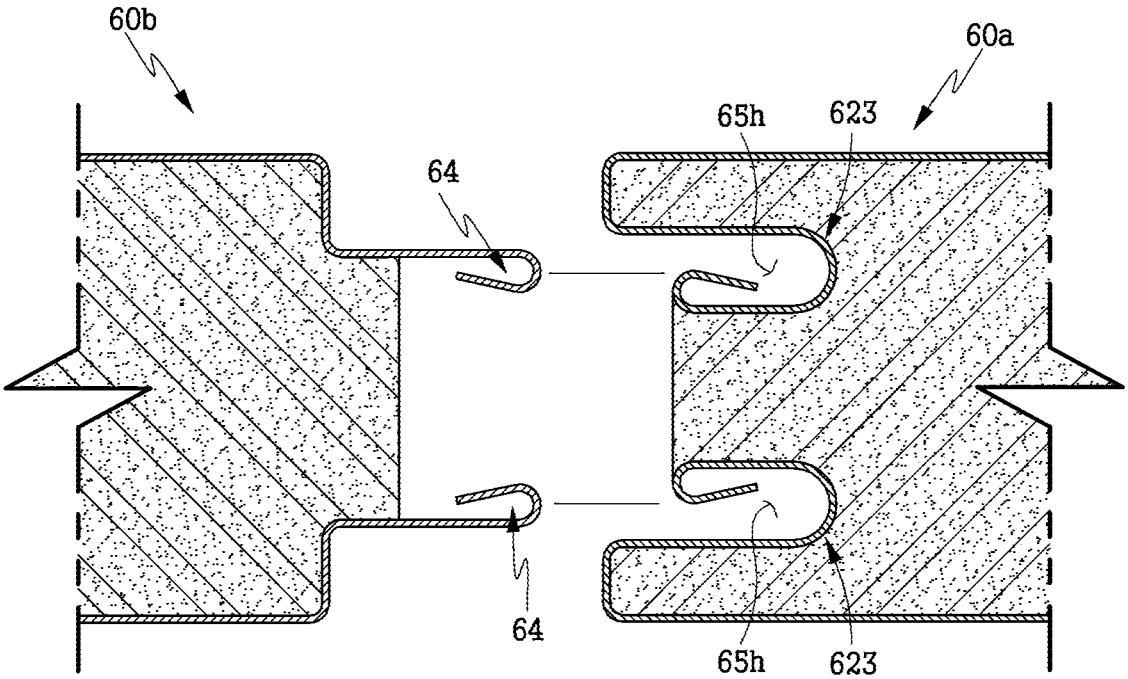
[FIG. 11]
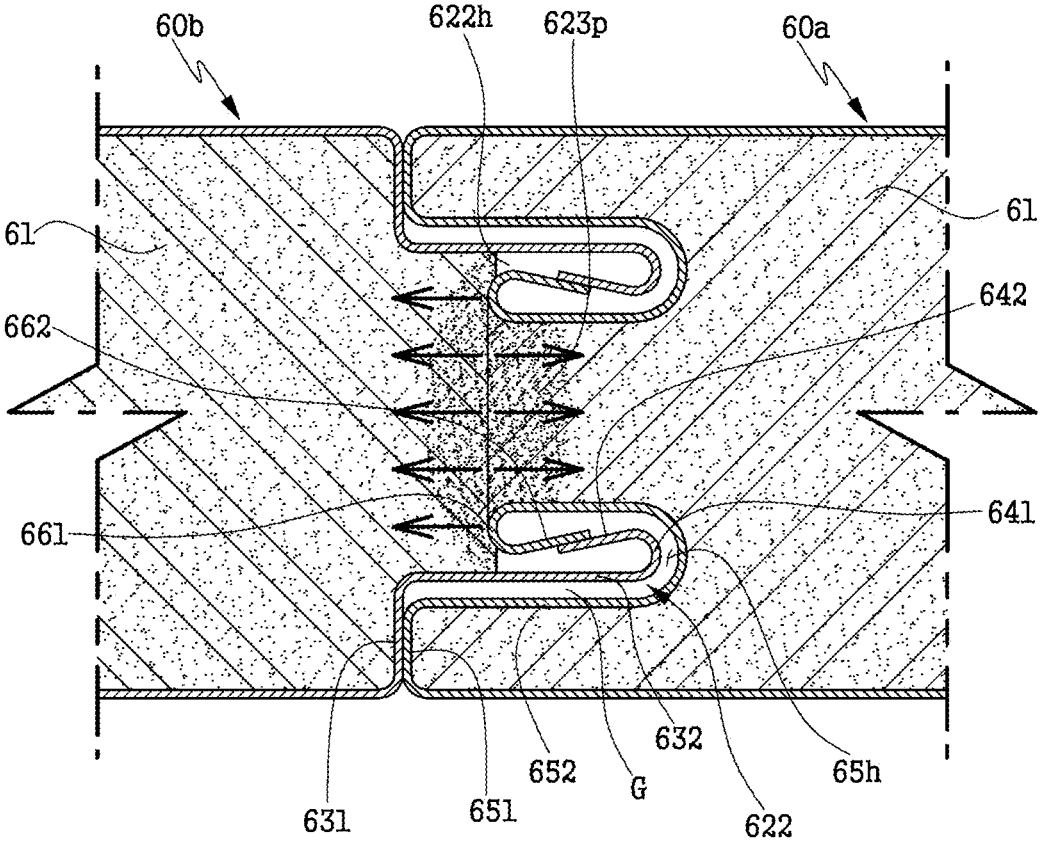

[FIG. 12]
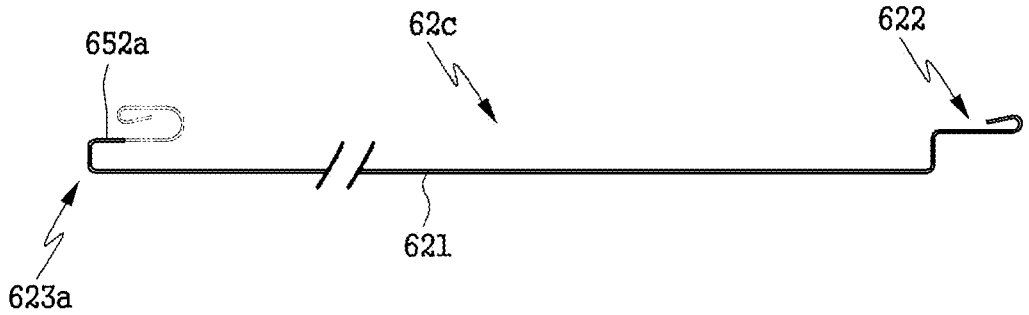
[FIG. 13]
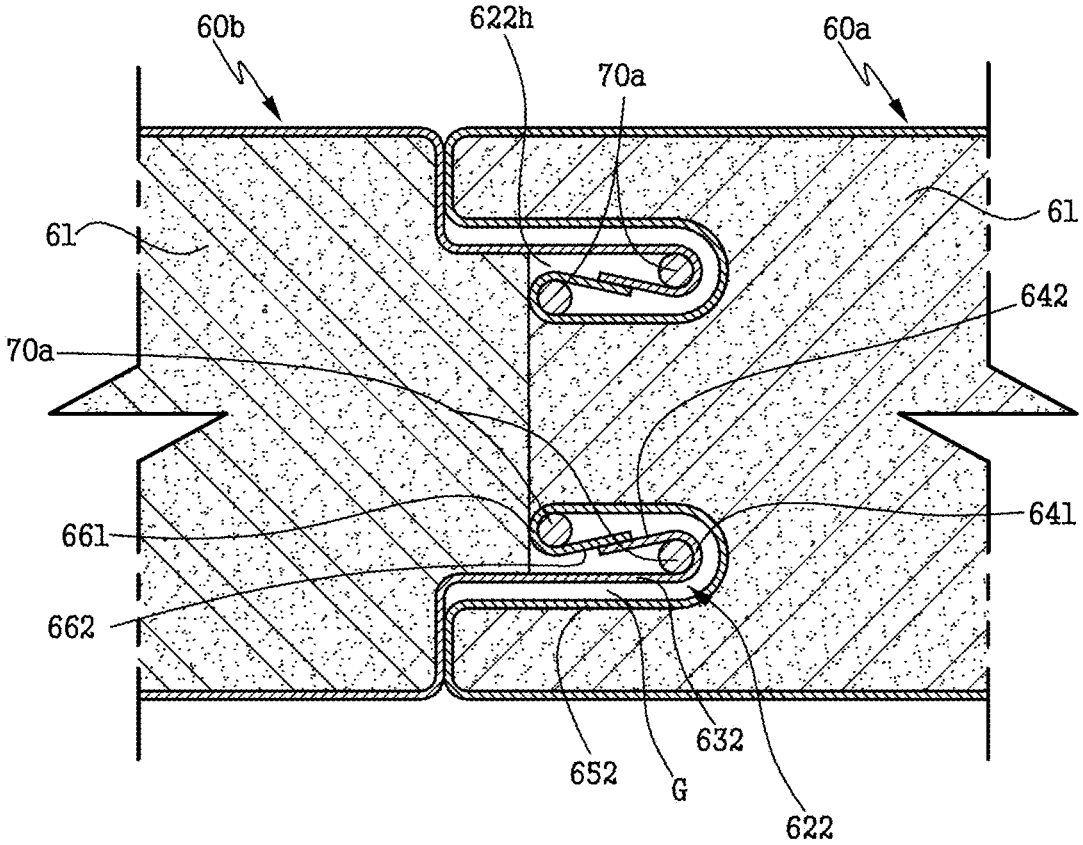

[FIG. 14]
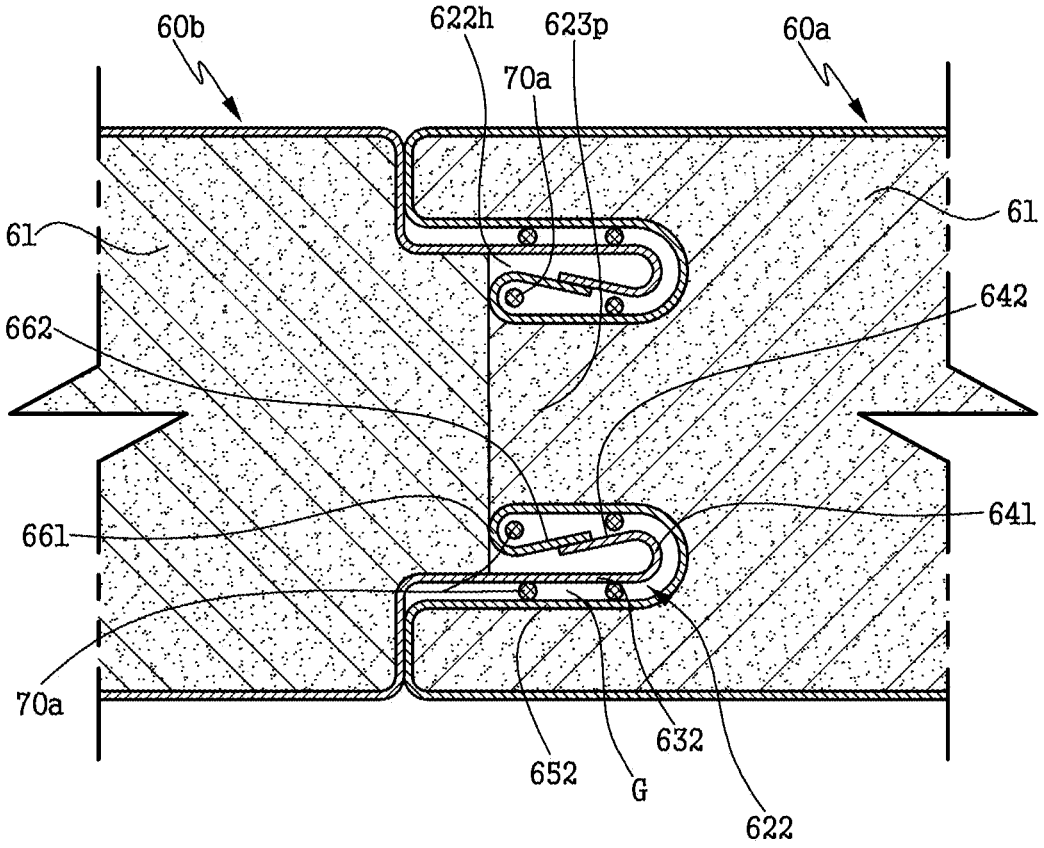

[FIG. 15]
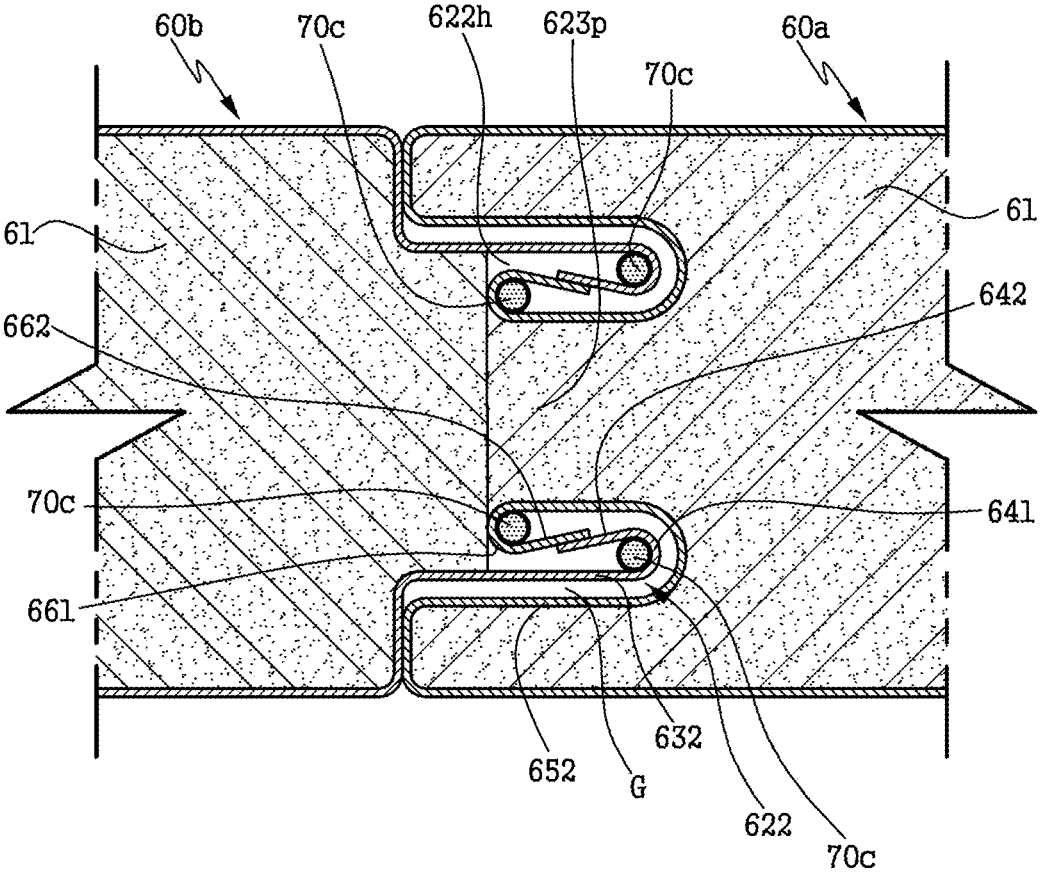

[FIG. 16]
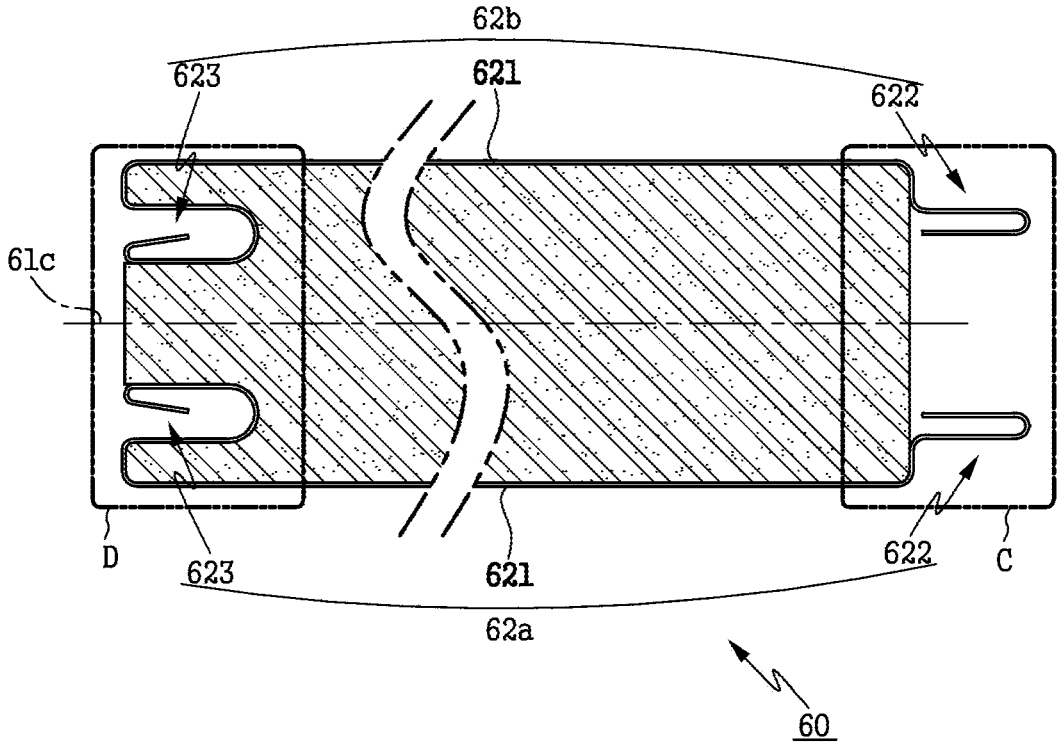

[FIG. 17]
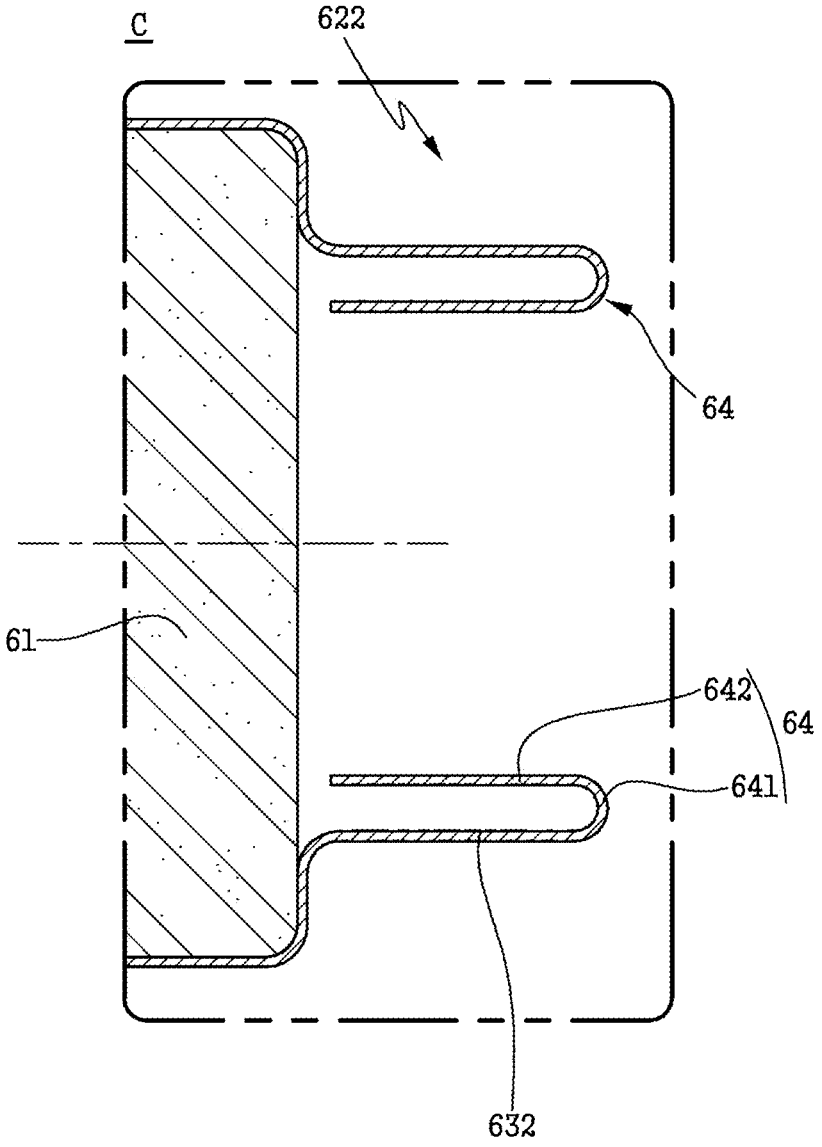

[FIG. 18]
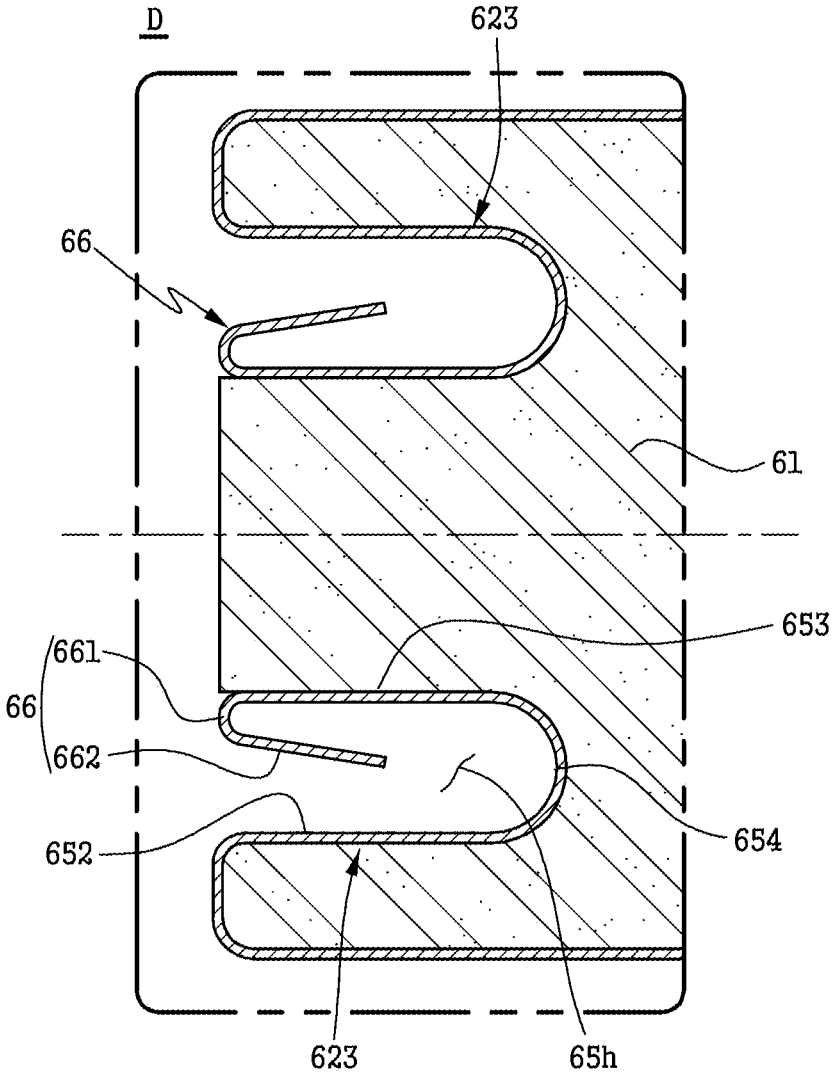

[FIG. 19]
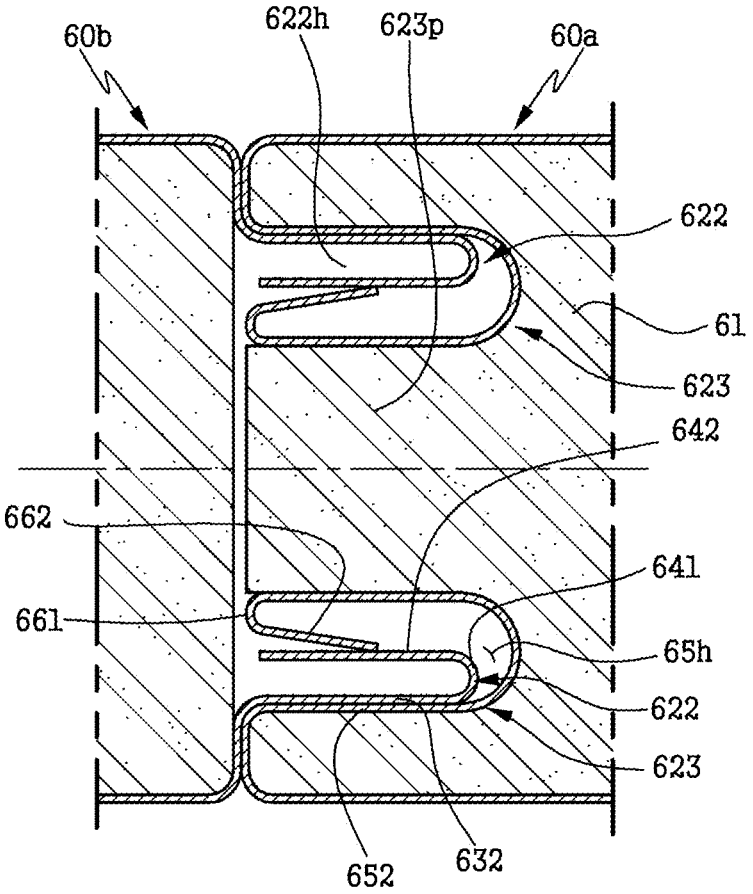

SANDWICH PANEL

TECHNICAL FIELD

This application claims benefit of priority to Korean Patent Application No. 10-2022-0087980, filed on 07.18.2022, in the Korean Intellectual Property Office, the disclosures of which are incorporated herein by reference in their entirety.

BACKGROUND ART

The present disclosure relates to a sandwich panel.

Buildings are constructed for people to live, work, or store things, and to protect people from natural disasters, animals, etc. Buildings are made of various materials such as wood, soil, stone, straw, ice, etc. depending on the living environment. Today, there is a trend to build buildings that are better in many aspects, including safety, design, and cost, and are made of materials such as concrete, metal, and cement.

In addition, in the case of prefabricated buildings, such as factories, warehouses, temporary buildings, and modular houses, sandwich panels are used to make walls, roofs, etc. Sandwich panels are made by bonding exterior panels on both sides of a core formed from materials such as rigid polyurethane foam, rock wool, glass wool, or intumescent polystyrene. Sandwich panels have a predetermined width and length and are arranged in an upright position in the longitudinal direction so that ends in the width direction are interlocked and connected to form a wall, roof, or the like.

FIG. 1 is a view schematically illustrating an end of a sandwich panel.

Referring to FIG. 1, a sandwich panel 10 has a core 11 and is combined with exterior panels 12*a* and 12*b* on one side and the other side thereof. On one end of the sandwich panel 10 in the width direction, a groove portion 13 is formed, and on the other end in the width direction, a protruding portion 14 is formed. The groove portion 13 is formed as the ends of the exterior panels 12*a* and 12*b* protrude from the sides of the core 11. The protruding portion 14 is formed as the other end of the sandwich panel 10 is made in the form of a step so that it has a shape that can be inserted into the groove portion 13 of a neighboring sandwich panel. The core 11 has an exposed circumference (side) except for one side and the other side.

The sandwich panel 10 is connected consecutively by inserting the protruding portion 14 of a rear end sandwich panel 10*b* into the groove portion 13 of a front end sandwich panel 10*a* while arranged to form a wall or roof. As a building is constructed in a manner in which the sandwich panels 10*a* and 10*b* are assembled by connecting them together, a joint portion 10*j* is formed at approximately one meter intervals.

Meanwhile, the fact that a fire is burning can be described as combustion. Combustion can be described as a process in which heat is generated during a reaction in which a substance is combined with oxygen, causing the temperature to rise, resulting in 'an oxidation reaction phenomenon accompanied by intense heat and light.'

Fire can only occur when three conditions are fulfilled: fuel (combustible), heat (ignition source), and oxygen. If any one of these three elements is absent, fire cannot occur.

When a fire starts inside a building as the three elements of fire are fulfilled, the heat causes the joint portion 10*j* to deform and separate, and the flame enters through the gap 10*g* between the exterior panels of the sandwich panels 10*a* and 10*b* and is ignited by contact with the circumference of the core 11. In addition, as the flame passes through the joint portion 10*j*, a phenomenon of fire spreading occurs.

Therefore, when a fire occurs in a building constructed with sandwich panels, the flash-over time is within 5 to 7 minutes, which is faster than the arrival time of the fire brigade, making it difficult to extinguish the fire and the preparation time is very short. In addition, toxic gases and smoke generated by the burning of the core 11 composed of organic materials are emitted, causing damage to human life and property.

In order to resolve these problems, Application No. 10-2015-0121788 (Aug. 28, 2015), Title: Combination of prefabricated sandwich panels (background art 1), Application No. 10-2016-0091307 (Jul. 19, 2016), Title: Fire spread prevention structure of building panel and construction method thereof (background art 2), Application No. 10-2020-0133804 (Oct. 15, 2020), Title: Heat diffusion and flame penetration blocking type flame retardant sandwich panel and its installation method (background art 3), Application No. 10-2015-0123976 (Sep. 2, 2016), Title: Flame retardant sandwich panel structure (background art 4) is proposed.

In the following, the background arts will be briefly described.

FIG. 2 is a view schematically illustrating an assembly of prefabricated sandwich panels of the background art 1.

Referring to FIG. 2, the background art 1 comprises a metal side plate 21 disposed between the two sandwich panels 20*a* and 20*b* to form a separation space therebetween, which prevents the rapid spread of fire toward adjacent panels when a fire occurs.

FIG. 3 is a view schematically illustrating a fire spread prevention structure of construction panels of the background art 2.

Referring to FIG. 3, the background art 2 is a configuration in which a fire spread preventing structure 30 comprising a rigid plate 31 and an intumescent cover 32 is disposed between the connecting construction panels (sandwich panels) P1 and P2 to prevent flame and smoke from spreading through the joint of the construction panels.

FIG. 4 is a view schematically illustrating a flame-retardant sandwich panel of the background art 3 that blocks thermal diffusion and flame penetration.

Referring to FIG. 4, the prior art 3 includes a front facing cover plate 41*a*, a rear facing cover plate 41*b*, a protruding portion 42 protruding from one side of the front facing cover plate 41*a* and the rear facing cover plate 41*b*, a recessed portion 43 recessed into the other side of the front facing cover plate 41*a* and the rear facing cover plate 41*b*, and a filling material 44 filled between the front facing cover plate 41*a* and the rear facing cover plate 41*b*. The protruding portion 42 and the recessed portion 43 are optionally provided with an intumescent heat spreading blocker or graphite-based flame retardant coating to block thermal diffusion and flame penetration.

However, since the background art 1 disposes the side plate 21 between the connecting sandwich panels, the background art 2 disposes the fire spread preventing structure 30 between the connecting building panels, and the background art 3 disposes the metal protruding portion 42 and recessed portion 43 between the connecting flame retardant sandwich panels, the cost of manufacturing the sandwich panels increases due to the addition of separate components other than the filling material 44 and the cover plates 41*a* and 41*b*.

FIG. 5 is a view schematically illustrating a flame retardant sandwich panel structure of the background art 4.

Referring to FIG. 5, the background art 5 is a sandwich panel structure in which a panel body filled with a filler material 52 is disposed continuously between exterior panels 51 spaced apart from each other. On one end of the exterior panel 51, a deformable joint portion 51*a* is formed that extends forward and deforms in shape in accordance with a physical property change. On the other end of the exterior panel 51, the deformable joint portion 51*a* is inserted and a hooking joint portion 51*b* is formed in close contact with the deformable joint portion 51*a* that expands when the physical properties change. In such a sandwich panel, the adhesion force of the deformable joint portion 51*a* and the hooking joint portion 51*b* blocks the channel for airflow and prevents flame from passing through the joint portion.

However, in the hooking joint portion 51*b*, a hooking groove 51*h* in which the deformable joint portion 51*a* is deformed and hooked is formed. Since there was a problem that the sandwich panel cannot be separated due to the hooking of the deformable joint portion 51*a*, the disassembling operation of the sandwich panel was inconvenient. In addition, since the deformable joints portion 51*a* were bound each other only by the deformation in shape, the binding force was deteriorated.

The spread of fire through the joint portions of these sandwich panels causes great danger to the evacuation of occupants and the firefighters' ability to extinguish the fire, and also causes continuous building fires, resulting in loss of life and property.

In addition, the formation of additional configurations such as side plates, anti-spread structures, metal protruding portions and recessed portions to prevent the spread of flames has contributed to the increase in the production cost of sandwich panels.

Meanwhile, sandwich panel manufacturers utilize metal coils with a width of 1,040 mm or 1,070 mm supplied by steel companies. The sandwich panel manufacturers had to install sandwich panel manufacturing equipment exclusive for 1,040 mm and exclusive for 1,070 mm according to the width of the metal coil supplied by the steel companies.

Since the sandwich panel manufacturing equipment had to be installed according to the width of the metal coil, the cost of installing the equipment increased, and the difficulty of maintenance increased the fatigue of supervisors. Since the sandwich panel manufacturing equipment was installed according to the specifications of the metal coil, the installation area per unit area increased.

DISCLOSURE OF THE INVENTION

Technical Problem

The present disclosure provides a technology that enables the exterior panel of the sandwich panel to block flames from itself.

The present disclosure provides a technology that increases the binding force of the joint portions of neighboring sandwich panels to delay the flame that may enter through the joint portions from reaching the core, thereby securing the evacuation of occupants and the entry time of firefighters to safely protect people from fire.

The present disclosure provides a technology that increases the adhesion force by deforming the ends of the exterior panel due to flame at the joint portions of the sandwich panel to prevent flame from passing through the joint portion.

The present disclosure provides a technology that allows the neighboring sandwich panels to be connected only with the exterior panel forming the surface of the sandwich panel when connecting the neighboring sandwich panels, so that no additional joining configuration is generated.

The present disclosure provides a technology that enables the neighboring sandwich panels to be firmly joined by the elastic force of the exterior panel and to be easily separated

Technical Solution

According to an embodiment of the present disclosure, the sandwich panel includes a core, and an exterior panel disposed on one side and the other side of the core respectively.

The exterior panel includes a body in contact with the core, a hooking portion exhibiting elastic force toward a first direction perpendicular to one side of the body at one end of the body, and a groove portion exhibiting elastic force toward a second direction perpendicular to one side of the body at the other end of the body and having an accommodating groove.

An inflow protruding portion filled with the core is formed at the groove portion, and an inflow groove is formed by the omission of the core at the hooking portion, wherein thermal energy applied to the body is transferred to the hooking portion and the groove portion, and the hooking portion and the groove portion are deformable by the thermal energy.

The hooking portion may include a hooking member bent multiple times at right angles at one end of the body and protruding toward the direction away from the body, and a hooking elastic member slantly bent with a curvature toward the direction of the body at the hooking member.

The groove portion may include a groove member bent multiple times at the other end of the body to form an accommodating groove, and a groove elastic member slantly bent with a curvature toward the accommodating groove at the groove member and is deformable by the transferred thermal energy.

The hooking elastic member may include a hooking curvature portion connected to the hooking member and formed in a semicircular shape, and a hooking contact portion protruding toward the direction of the core at the hooking curvature portion.

The hooking contact portion may slantly protrude toward the direction to the hooking member.

An end of the hooking contact portion is spaced apart from the hooking member.

The groove elastic member includes a groove curvature portion connected to the groove member and formed by bending toward the direction of the accommodating groove in a semicircular shape, and a groove contact portion protruding toward the circumferential direction of the accommodating groove at the groove curvature portion.

An end of the groove contact portion is spaced apart from the bottom of the accommodating groove.

The groove contact portion may be slantly protruding toward the circumference of the accommodating groove.

The body, the hooking portion and the groove portion may be formed from a metal coil having a width of 1,070 mm using a forming roller in a manufacturing apparatus.

The hooking portion may include a hooking member bent multiple times at one end of the body and protruding toward the direction away from the body, and a hooking elastic member slantly bent with a curvature toward the direction of the body at the hooking member.

The groove portion may include a groove member bent at the other end of the body to form an accommodating groove.

The body, the hooking portion and the groove portion may be formed from a metal coil having a width of 1,040 mm using a forming roller in a manufacturing apparatus.

The first direction may be the direction away from one side of the body, and the second direction may be the direction approaching to one side of the body.

The sandwich panel is arranged for building construction and an inflow protruding portion of a rear end sandwich panel is inserted into an inflow groove portion of a front end sandwich panel, and the hooking elastic member of the hooking portion is inserted into the accommodating groove so that the hooking contact portion of the hooking portion and the groove contact portion of the groove portion, which exhibit elastic force toward the opposite direction of each other, elastically contact each other, and the hooking contact portion and the groove contact portion are closely contacted by deformation of the hooking portion and the groove portion by the thermal energy, and the hooking portion and the groove portion are oxidized and combined with oxygen by the thermal energy so that oxygen between the front end sandwich panel and the rear end sandwich panel may be reduced.

The sandwich panel may further include a blocking portion disposed at the groove portion and the hooking portion respectively, and deformed by flame so that the spread of the flame introduced between the front end sandwich panel and the rear end sandwich panel is retarded.

The blocking portion may include a dilative intumescent sheet disposed around the groove contact portion and the hooking contact portion respectively, and expanded by the introduced flame and thereby making the groove contact portion and hooking contact portion closely contacted each other.

The blocking portion may include a metal material capable of combining with oxygen by being oxidized by the flame.

The blocking portion may include a fire extinguishing pack filled with an extinguishing material and opened by the flame introduced between the front end sandwich panel and the rear end sandwich panel to release the extinguishing material.

Advantageous Effects

According to an embodiment of the present disclosure, as the thermal energy applied to the body of the exterior panel is transferred to the hooking portion and the groove portion, the hooking contact portion of the hooking portion and the groove contact portion of the groove portion that were in contact with each other are brought into tight contact, thereby sealing the gap between them. As a result, the end of the exterior panel is deformed by the thermal energy of the flame and blocks the flame in the passage by itself, thereby delaying the flame.

According to an embodiment of the present disclosure, when a fire breaks out in a building, the entrance of the flames into the passage can be minimized and delayed by the contact of the hooking contact surface and the groove contact surface. In addition, the tight contact of the groove contact portion and the hooking contact portion delays and minimizes the contact of the flames in the passage with the sides of the core. Thus, the evacuation of the building occupants and the entry time of the firefighters can be secured, and humans can be safely protected from the fire.

According to an embodiment of the present disclosure, the groove contact portion and the hooking contact portion can be brought into closer contact as the blocking portion of the dilative intumescent sheet is expanded by the flame. Thus, the time for the flame to spread into the passage of the joint portion and reach the core is delayed and minimized.

According to an embodiment of the present disclosure, the metal material in the passage oxidizes and combines with the oxygen in the passage. At this time, the oxygen in the passage may be reduced. The flame introduced into the passage may be weakened due to the reduction of oxygen. This has the effect of delaying the time for the flame to spread into the passage and reach the core.

According to an embodiment of the present disclosure, a fire extinguishing pack filled with an extinguishing material consisting of carbon dioxide gas is disposed in the passage and the pack is opened by the temperature of the flame. At this time, the increase of carbon dioxide gas in the passage has the effect of extinguishing the flame spreading in the passage.

According to an embodiment of the present disclosure, the flame is delayed firstly at the hooking contact surface and the groove contact surface, and secondly at the groove contact portion and the hooking contact portion, and thirdly at the side circumference of the densified core, which slows down the flash-over time, thereby increasing the effectiveness of firefighters in extinguishing the fire.

According to an embodiment of the present disclosure, the exterior panel alone delays and prevents the passage of flame between the neighboring sandwich panels, thereby simplifying the structure of the sandwich panels by eliminating additional configurations such as side plates, anti-spread structures, metal protruding portion and recessed portion, and the like, as conventionally used.

According to an embodiment of the present disclosure, an exterior panel can be processed through a manufacturing apparatus dedicated to a metal coil with a width of 1,070 mm, and a metal coil with a width of 1,040 mm can be supplied to a manufacturing apparatus dedicated to a metal coil with a width of 1,070 mm for processing into an exterior panel. Since metal coils of different widths can be processed through a single manufacturing apparatus, it is not necessary to change the manufacturing apparatus depending on the width of the metal coil, thus the workability of the operator is improved.

According to an embodiment of the present disclosure, since the metal coils produced by metal coil manufacturers with a width of 1,040 mm or 1,070 mm can be used as is, no additional processing such as cutting is required, which has the effect of improving the manufacturability of exterior panels and sandwich panels.

BRIEF DESCRIPTION OF THE DRAWINGS

FIG. 1 is a view schematically illustrating a conventional sandwich panel;

FIG. 2 is a view schematically illustrating a conventional prefabricated sandwich panel assembly;

FIG. 3 is a view schematically illustrating an anti-fire spread structure of a conventional construction panel;

FIG. 4 is a view schematically illustrating a conventional flame-retardant sandwich panel that blocks thermal diffusion and flame penetration;

FIG. 5 is a view schematically illustrating a conventional flame-retardant sandwich panel structure;

FIG. 6 is a perspective view schematically illustrating a sandwich panel according to an embodiment of the present disclosure;

FIG. 7 is a cross-sectional view schematically illustrating the sandwich panel of FIG. 6;

FIG. 8 is an enlarged view of portion A of FIG. 7;

FIG. 9 is an enlarged view of portion B of FIG. 7;

FIG. 10 is an exploded view schematically illustrating a state in which the sandwich panels of FIG. 6 are connected;

FIG. 11 is a cross-sectional view schematically illustrating a state in which the sandwich panels of FIG. 10 are connected;

FIG. 12 is a view schematically illustrating another embodiment of the exterior panel of FIG. 7;

FIG. 13 is a view schematically illustrating a sandwich panel according to another embodiment of the present disclosure;

FIG. 14 is a view schematically illustrating a sandwich panel according to another embodiment of the present disclosure;

FIG. 15 is a view schematically illustrating a sandwich panel according to another embodiment of the present disclosure;

FIG. 16 is a view schematically illustrating a sandwich panel according to another embodiment of the present disclosure;

FIG. 17 is an enlarged view of portion C of FIG. 16;

FIG. 18 is an enlarged view of portion D of FIG. 16;

FIG. 19 is a cross-sectional view schematically illustrating a state in which the sandwich panels of FIG. 16 are connected.

BEST MODE FOR CARRYING OUT THE INVENTION

Hereinafter, embodiments of the present disclosure will be described in detail with reference to the accompanying drawings to facilitate implementation by those of ordinary skill in the art to which the present disclosure belongs. However, the present disclosure may be implemented in many different forms and is not limited to the embodiments described herein. Throughout the specification, same drawing symbols are used for similar parts.

A sandwich panel according to an embodiment of the present disclosure will now be described with reference to FIGS. 6 through 11.

FIG. 6 is a perspective view schematically illustrating a sandwich panel according to an embodiment of the present disclosure, FIG. 7 is a cross-sectional view schematically illustrating the sandwich panel of FIG. 6, FIG. 8 is an enlarged view of portion A of FIG. 7, FIG. 9 is an enlarged view of portion B of FIG. 7, FIG. 10 is an exploded view schematically illustrating a state in which the sandwich panels of FIG. 6 are connected, and FIG. 11 is a cross-sectional view schematically illustrating a state in which the sandwich panels of FIG. 10 are connected.

Referring first to FIGS. 6 and 7, a sandwich panel 60 according to the present embodiment includes a core 61 and exterior panels 62*a* and 62*b*, which are arranged on the ground where the building is to be constructed to form a wall. The sandwich panel 60 provides enhanced flame-retardant and blocking capabilities with only the exterior panels without utilizing any additional configuration. However, the sandwich panels 60 may form a roof. The sandwich panels forming the roof may have enhanced flame retardant, blocking, and water resistance functions. In this case, the flame retardant, blocking, and water resistance functions are performed at the joint portions of the sandwich panels 60 that are connected continuously.

A core 61 may be made of rigid polyurethane foam, rock wool, glass wool, intumescent polystyrene, or the like, and may have flame retardant and non-flammable characteristics. The core 61 may serve an insulating function in a building. The material of the core 61 may be varied depending on the design of the building being constructed.

The exterior panels 62*a* and 62*b* are disposed on one side and the other side of the core 61, respectively. The exterior panels 62*a* and 62*b* on one side and the other side are symmetrically formed based on a thickness center 61*c* of the core 61. The exterior panel 62*a* disposed on one side of the core 61 constitutes the interior side of the building, and the exterior panel 62*b* disposed on the other side of the core 61 constitutes the exterior side of the building.

The exterior panels 62*a* and 62*b* disposed on one side and the other side of the core 61 have the same composition and operational effect, respectively. Thus, the following description is based on the exterior panel 62*a* disposed on one side of the core 61.

The exterior panel 62*a* includes a body 621, a hooking portion 622, and a groove portion 623, and has a predetermined thickness, and integrally formed from a metal coil with a width of 1,070 mm.

The body 621 is coupled to the core 61 on one side and the other side is exposed.

The hooking portion 622 is formed on one end of the body 621 in the width direction and the groove portion 623 is formed on the other end of the body 621 in the width direction. The hooking portion 622 and the groove portion 623 are formed continuously along the length direction of the exterior panel 62*a*.

The exterior panel 62*a* is formed as the metal coil passes through the manufacturing apparatus (not shown) of the sandwich panel 60. In other words, one end and the other end of the metal coil in the width direction are bent as it passes through the forming roller arranged in the manufacturing apparatus to form the hooking portion 622 and the groove portion 623. The metal coil passes through the manufacturing apparatus on the basis of one end, and the hooking portion 622 and the groove portion 623 form the body 621.

When the exterior panel 62*a* is disposed on one side of the core 61, the body 621 is formed with a plain pattern. However, the body 621 may be patterned to design the interior surface of the building. Since the exterior panel 62*b* disposed on the other side of the core 61 forms the exterior surface of the building, a patterned portion (not shown) may be formed on the body 621 as the metal coil passes through the manufacturing apparatus for the design of the building.

The forming of the patterned portion of the body 621 may vary depending on the side on which the exterior panel 62*a* is disposed on the core 61. In addition, the forming and design of the patterned portion may vary depending on the design of the building being constructed by the assembly of the sandwich panels 60.

Next, the hooking portion 622 will be described with reference to FIG. 8.

Referring to FIG. 8, the hooking portion 622 includes a hooking member 63 and a hooking elastic member 64, which serves as a male member in the coupling structure. The hooking member 63 and the hooking elastic member 64 are formed by bending one side of the metal coil by the forming roller.

The hooking member 63 includes a hooking contact surface 631 having a predetermined length perpendicular to the direction of the core 61 at one end of the body 621, and a hooking insert portion 632 protruding perpendicularly from the hooking contact surface 631 toward the direction away from the body 621.

The hooking contact surface 631 is integrally connected to the core 61. The hooking insert portion 632 is only partially coupled to the core 61 and the other part is not coupled to the core 61. Thus, the other part of the hooking insert portion 632 is formed in a protruding shape at the side of the core 61. The other part of the hooking insert portion 632 forms an inflow groove 622*h*.

The hooking elastic member 64 includes a hooking curvature portion 641 bent with a curvature toward the direction of the core 61 at an end of the hooking insert portion 632, and a hooking contact portion 642 protruding toward the direction of the core 61 at an end of the hooking curvature portion 641.

The hooking curvature portion 641 is larger than a two-quarter circle and smaller than a three-quarter circle. The hooking contact portion 642 is tangentially connected to the hooking curvature portion 641 and slantly protruding toward the hooking insertion portion 632. The protruding length of the hooking contact portion 642 is shorter than the protruding length of the hooking insert portion 632. The inclination angle 642*r* of the hooking contact portion 642 may be 75° to 85° to an imaginary vertical line 632*h* protruding from the hooking insert portion 632. An end of the hooking contact portion 642 is away from the hooking insert portion 632 and may exhibit elastic force. The hooking contact portion 642 may exhibit elastic force toward a first direction away from one side of the body 621. One side of the body 621 may be a side in contact with the core 61. The first direction is perpendicular to one side of the body 621 and is directed toward the center of thickness 61*c* of the core 61.

At this time, when the angle of the hooking contact portion 642 is formed at less than 75° with the imaginary vertical line 632*t*, the elastic force exhibited is insufficient, and when it is formed at more than 85°, the adhesion force with the groove portion 623 is weak, and the airtightness may be reduced.

Next, the groove portion 623 will be described with reference to FIG. 9.

Referring to FIG. 9, the groove portion 623 includes a groove member 65 and a groove elastic member 66, which serves as a female member in the coupling structure. The groove member 65 and the groove elastic member 66 are formed by bending the other end of the metal coil by the forming roller, and are connected to the body 621 to form an integrally formed body.

The groove member 65 includes a groove contact surface 651 having a predetermined length vertically bent toward the direction of the core 61 at the other end of the body 621, a first groove plane 652 vertically protruding into the interior of the core 61 at an end of the groove contact surface 651, a second groove plane 653 facing and parallel to the first groove plane 652 and having a length shorter than the first groove plane 652, and a connection surface 654 connecting the first groove plane 652 and the second groove plane 653 in the interior of the core 61.

Based on the other side of the body 621, the length of the groove contact surface 651 is shorter than the length of the hooking contact surface 631. A one-sided open accommodating groove 65*h* is formed in the groove member 65 by the first groove surface 652, the second groove surface 653, and the connection surface 654. The connection surface 654 is formed as a semicircle. Here, the second groove plane 653 is formed in a protruding shape at the connection surface 654. The groove member 65 is contacted and hooked with the core 61 and an inflow protruding portion 623*p* is formed at the groove portion 623 by the second groove plane 653.

Since the length of the second groove plane 653 is shorter than the length of the first groove plane 652, the groove contact surface 651 protrudes further than the end of the inflow protruding portion 623*p* based on the connection surface 654.

The groove elastic member 66 includes a groove curvature portion 661 bent with a curvature toward the direction of the connection surface 654 at an end of the second groove plane 653, and a groove contact portion 662 tangentially connected to the groove curvature portion 661 and protruding toward the direction of the second groove plane 653. An end of the groove contact portion 662 is spaced apart from the second groove plane 653 and may exhibit elastic force.

Here, the groove curvature portion 661 and the groove contact portion 662 of the groove elastic member 66 have the same configuration and operational effect as the hooking curvature portion and the hooking contact portion of the hooking elastic member 64. Thus, a duplicate description will be omitted. However, the groove contact portion 662 may exhibit elastic force toward a second direction that approaches one side of the body 621. The second direction is perpendicular to one side of the body 621 and is the direction away from the center of thickness 61*c* of the core 61.

Next, the connection of the sandwich panels will be described with reference to FIGS. 10 and 11.

Hereinafter, the construction of a wall using the sandwich panels will be described.

First, referring to FIG. 10, the sandwich panels 60*a* and 60*b* have an upper and lower length and a width from left to right and are arranged along one direction to form a wall. When the front end sandwich panel 60*a* and the rear end sandwich panel 60*b* are disposed on the same line, the groove portion 623 of the front end sandwich panel 60*a* and the hooking portion 622 of the rear end sandwich panel 60*b* are matched. To form a wall, it is necessary to continuously connect the front end sandwich panel 60*a* and the rear end sandwich panel 60*b* by inserting the hooking elastic member 64 of the rear end sandwich panel 60*b* into the accommodating groove 65*h* of the front end sandwich panel 60*a*.

Referring to FIG. 11, when the other part of the hooking insert portion 632 is inserted into the accommodating groove 65*h* while the other sides of the front end sandwich panel 60*a* and the rear end sandwich panel 60*b* are in the same plane, the hooking curvature portion 641 and the groove curvature portion 661 will contact each other and the other part of the hooking insert portion 632 will be bent toward the direction of the first groove plane 652 and be accommodated in the accommodating groove 65*h*. As the hooking insert portion 632 is accommodated, the hooking contact portion 642 and the groove contact portion 662 progressively contact. The hooking insert portion 632 bent by the inclined surfaces of the hooking contact portion 642 and the groove contact portion 662 returns to its original state, and the hooking insert portion 632 and the first groove plane 652 become spaced apart and parallel at a distance.

When the hooking portion 622 is fully inserted into the accommodating groove 65*h*, the curved hooking insert portion 632 is fully returned to its original state by elastic force, and the ends of the hooking contact portion 642 and the groove contact portion 662 are close together and in a state of contact each other.

At the same time, the inflow protruding portion 623*p* becomes inserted into the inflow groove 622*h*, and the side of the core 61 of the front end sandwich panel 60*a* and the side of the core 61 of the rear end sandwich panel 60*b* come into contact with each other. At this time, the inflow protruding portion 623*p* may be inserted into the inner part of the side of the core 61 of the rear end sandwich panel 60*b*. And the core 61 parts of the front end sandwich panel 60*a* and the rear end sandwich panel 60*b* are pressed against each other and become denser.

And, the groove contact surface 651 and the hooking contact surface 631, and the groove contact portion 662 and the hooking contact portion 642 are in contact with each other. At this time, the groove contact portion 662 and the hooking contact portion 642 exhibit elastic force toward the direction of contacting each other, thereby increasing their adhesion force to each other. Due to the close contact of the two contact portions 642 and 662, the front end sandwich panel 60*a* and the rear end sandwich panel 60*b* may remain interlocked with each other.

Meanwhile, the length of the hooking contact surface 631 is longer than the length of the groove contact surface 651 based on the other side of the body 621, so that the other sides of the body 621 of the front end sandwich panel 60*a* and the rear end sandwich panel 60*b* are on the same line, and the hooking insert portion 632 and the first groove plane 652 are facing each other at a distance. The circumference of the hooking elastic member 64 is spaced apart from the circumference of the connection surface 654 and the second groove plane 653, and a passage G is formed therebetween. The passage G is blocked from the sides of the core 61 by the contact of the hooking contact surface 631 and the groove contact surface 651 and by the adhesion of the groove contact surface 662 with the hooking contact surface 642.

The thermal energy of a fire caused by three conditions such as fuel (combustible), heat (ignition source), and oxygen inside the building, travels to the exterior panel 62*a*, and the exterior panel 62*a* may oxidize and combine with oxygen. The thermal energy of the exterior panel 62*a* may be transferred to the edge of the exterior panel 62*a*. At this time, the contacting hooking contact portion 642 and the groove contact portion 662 may deform and become more closely contacted to each other. The flame entering the passage G may be delayed and minimized from contacting the sides of the core 61 by the adhesion of the hooking contact portion 642 and the groove contact portion 662. Thus, the exterior panel 62*a* itself has the effect of delaying and blocking the flame as it is deformed by the transferred thermal energy without any additional components.

And, the end of the exterior panel 62*a* on which the hooking contact part 642 and the groove contact portion 662 are formed may also oxidize and combine with oxygen in the passage G. Thus, the effect of reducing the oxygen in the passage G occurs. Thus, the exterior panel 62*a* itself has the effect of delaying and blocking the flame.

Thus, when a fire occurs in the building, the contact of the hooking contact surface 631 and the groove contact surface 651 may minimize and delay the entry of flames into the passage G.

In addition, the flame in the passage G may be delayed from contacting the sides of the core 61 by the close contact of the groove contact portion 662 and the hooking contact portion 642. And the flame may be delayed from entering into the inside of the core 61 of the front end sandwich panel 60*a* and the rear end sandwich panel 60*b* by the increased density due to the contact of the side of the core 61 of the front end sandwich panel 60*a* and the side of the core 61 of the rear end sandwich panel 60*b*.

Thus, the flame is firstly delayed at the hooking contact surface 631 and the groove contact surface 651, secondly delayed at the groove contact portion 662 and the hooking contact portion 642, and thirdly delayed at the side circumference of the densified core 61, which slows down the flash-over time, thereby increasing the firefighting effectiveness of the fire brigade.

And the blocking of the passage G minimizes the flame from passing through the connection part between the front end sandwich panel 60*a* and the rear end sandwich panel 60*b*, thereby having the effect of preventing the spread of the fire.

Since the exterior panels 62*a* and 62*b* itself delay and block the passage of flame between the neighboring sandwich panels 60*a* and 60*b*, no additional configuration is used as in the conventional art, which has the effect of reducing the manufacturing cost of the sandwich panels.

Meanwhile, when the front end sandwich panel 60*a* and the rear end sandwich panel 60*b* are separated, the other part of the hooking insert portion 632 that is not contacting the core 61 may be bent toward the direction of the first groove plane 652. In other words, the hooking insert portion 632, which forms the inflow groove 622*h*, is getting wider at the inflow protruding portion 623*p*, which has the effect of facilitating the separation of the front end sandwich panel 60*a* and the rear end sandwich panel 60*b*. Thus, the efficiency of wall construction and demolition of the building is high.

Next, another embodiment of the present disclosure will be described with reference to FIG. 12.

FIG. 12 is a view schematically illustrating another embodiment of the exterior panel of FIG. 7.

Other embodiments of the present disclosure have most of the components of the embodiments described with reference to FIGS. 6 through 11. However, in the present embodiment, the exterior panel 62*c* has a different structure.

The sandwich panel to which the exterior panel 62*c* according to the present embodiment is applied may have an enhanced waterproof function. The exterior panel 62*c* according to the present embodiment includes the body 621, the hooking portion 622, and the groove portion 623*a*, and is integrally formed by making a metal coil having a width of 1,040 mm. One side of the body 621 is coupled to the core 61 and the other side is exposed.

The detailed configuration of the body 621 and the hooking portion 622 according to the present embodiment is the same as the body and the hooking portion of the exterior panel described with reference to FIGS. 6 through 11, so that duplicate description will be omitted.

However, the exterior panel 62*c* according to the present embodiment is formed using a manufacturing apparatus that makes an exterior panel with a metal coil having a width of 1,040 mm and a metal coil having a width of 1,070 mm.

The metal coil having a width of 1,040 mm is supplied to the manufacturing apparatus based on one end, and the one end and the other end are bent while passing through the forming rollers disposed in the manufacturing apparatus so that the hooking portion 622 and the groove portion 623*a* are formed. Since the metal coil having a width of 1,040 mm is processed based on one end, the groove portion 623*a* of the other end has a different structure than the groove portion made of the metal coil having a width of 1,070 mm.

The groove portion 623*a* according to the present embodiment omits the second groove plane, the connecting surface, and the groove elastic member. However, only a part of the first groove plane 652*a* is molded. Since the exterior panel is formed with a metal coil having a width of 1,040 mm using a dedicated manufacturing apparatus that forms the exterior panel with a metal coil having a width of 1,070 mm, it is not necessary to change the manufacturing apparatus according to the width of the metal coil, which has the effect of improving the manufacturing efficiency of the exterior panel. In addition, since it uses the metal coil produced by the metal coil manufacturers with a width of 1,040 mm or 1,070 mm, no additional processing such as cutting is required, which lowers the manufacturing cost of exterior panels, sandwich panels, etc.

The exterior panel 62*c* according to the present embodiment may be disposed on one side of the sandwich panel to form an inner side. Further, the exterior panel disposed on the other side of the sandwich panel and exposed to the outside may include a cover. The cover prevents rainwater or the like from entering through the joint portion of the connected sandwich panels.

Other configurations may be applied in the configurations in the embodiments of FIGS. 6 through 11.

Next, another embodiment of the present disclosure will be described with reference to FIG. 13.

Referring to FIG. 13, another embodiment of the present disclosure has most of the components of the embodiments described with reference to FIGS. 6 through 12, but further includes a blocking portion 70*a*.

The blocking portion 70*a* according to the present embodiment is formed in the shape of a cylinder and is disposed continuously along the longitudinal direction of the front end sandwich panel 60*a* and the rear end sandwich panel 60*b* in the passage G. The blocking portion 70*a* is disposed between the groove contact portion 662 of the groove portion 623 and the second groove plane 653. The blocking portion 70*a* is also disposed between the hooking insert portion 632 and the hooking contact portion 642. However, the blocking portion 70*a* may be disposed at any of the selected locations between the groove contact portion 662 and the second groove plane 653 or between the hooking insert portion 632 and the hooking contact portion 642.

The blocking portion 70*a* may be a dilative intumescent sheet that expands when heat is applied. The dilative intumescent sheet is disposed in non-intumescent state in the peripheral passage G of the hooking contact portion 642 and the groove contact portion 662. The dilative intumescent sheet may include a matrix resin and thermally expandable graphite, and may intumesce when heated at 110° C. to 120° C. The detailed composition of the dilative intumescent sheet is the same as that of the dilative intumescent sheets in publicly known configurations, so detailed descriptions are omitted.

When a fire occurs and flame contacts the sandwich panel and the flame enters the passage G, the temperature of the passage G may increase. At this time, the dilative intumescent sheet may expand over an area that is larger than a cross-sectional area of the space between the groove contact portion 662 and the second groove plane 653 and a cross-sectional area of the space between the hooking insert portion 632 and the hooking contact portion 642. At this time, the groove contact portion 662 and the hooking contact portion 642 may be pressed by the expanding blocking portion 70*a* and getting closer to each other.

Thus, the flame in the passage G may be delayed from contacting the side of the core 61 due to the close contact of the groove contact portion 662 and the hooking contact portion 642.

Other configurations may be applied in the configurations in the embodiments of FIGS. 6 through 12.

Next, another embodiment of the present disclosure will be described with reference to FIG. 14.

Referring to FIG. 14, another embodiment of the present disclosure has most of the components of the embodiments described with reference to FIGS. 6 through 12, but further includes a blocking portion 70*b*.

The blocking portion 70*b* according to the present embodiment is disposed at least one in the passage G. The number of blocking portions 70*b* may vary depending on the design of the flame spread retardant construction panel 60. The blocking portions 70*b* are made of metal or the like and are disposed continuously along the longitudinal direction of the front end sandwich panel 60*a* and the rear end sandwich panel 60*b*.

The blocking portion 70*b* is oxidized by the energy of the flame entering the passage G, and at this time, it may be combined with oxygen entering the passage G from inside the building. Thus, the energy of the flame entering the passage G may be weakened by the reduced oxygen in the passage G. As a result, the time for the flame spreading as it enters the passage G to reach the core 61 may be delayed.

Other configurations may be applied in the configurations in the embodiments of FIGS. 6 through 12.

Next, another embodiment of the present disclosure will be described with reference to FIG. 15.

Referring to FIG. 15, another embodiment of the present disclosure has most of the components of the embodiments described with reference to FIGS. 6 through 12, but further includes a blocking portion 70C.

The blocking portion 70*c* according to the present embodiment is disposed at least one in the passage G. The blocking portion 70*c* is disposed continuously along the longitudinal direction of the front end sandwich panel 60*a* and the rear end sandwich panel 60*b*.

The blocking portion 70*c* may be a fire extinguishing pack that is filled with a fire extinguishing material inside and is partially opened to release the fire extinguishing material as it is melted by the flame. The extinguishing material may be carbon dioxide gas. The extinguishing material is not limited to carbon dioxide gas.

The passage G may be filled with carbon dioxide gas when the fire extinguishing pack is opened to release carbon dioxide gas. The flame introduced into the passage G may be extinguished by the carbon dioxide gas. In addition, the flame may be delayed in reaching the core by the carbon dioxide gas.

Other configurations may be applied in the configurations in the embodiments of FIGS. 6 through 12.

Next, another embodiment of the present disclosure will be described with reference to FIGS. 16 through 19.

Referring to FIGS. 16 through 19, another embodiment of the present disclosure has most of the components of the embodiments described with reference to FIGS. 6 through 13 and FIG. 15. However, the hooking elastic member 64 of the hooking portion 622 and the groove elastic member 66 of the groove portion 623 have different structures.

The hooking elastic member 64 according to the present embodiment includes a hooking curvature portion 641 and a hooking contact portion 642.

Referring to FIG. 17, the hooking curvature portion 641 is bent with a curvature toward the direction of the core 61 at the end of the hooking insert portion 632. The hooking curvature portion 641 is formed in a semicircular shape.

The hooking contact portion 642 protrudes toward the core 61 at the end of the hooking curvature portion 641. The hooking contact portion 642 is parallel to the hooking insert portion 632 and is facing the hooking insert portion 632 at a distance. The hooking contact portion 642 may be bent toward the direction of the hooking insert portion 632 by an external force.

The grooved elastic member 66 according to the present embodiment includes a groove curvature portion 661 and a groove contact portion 662.

Referring to FIG. 18, the groove curvature portion 661 is bent with a curvature toward the direction of the connection surface 654 at the end of the second groove plane 653. The groove curvature portion 661 is formed in a semicircular shape.

The groove contact portion 662 is tangentially connected to the groove curvature portion 661 and slantly protruding toward the first groove plane 652. The end of the groove contact portion 662 is further away from the second groove plane 653 as it moves away from the groove curvature portion 661. The groove contact portion 662 is bent toward the direction of the second groove plane 653 when an external force is applied, and elastic force is generated.

Next, the connection of the sandwich panels according to the present embodiment will be described with reference to FIG. 19.

When the hooking portion 622 is inserted into the groove portion 623 while the front end sandwich panel 60*a* and the rear end sandwich panel 60*b* are located on the same plane, the hooking curvature portion 641 is located in the accommodating groove 65*h*. At this time, the hooking insert portion 632 and the first groove plane 652 are in contact with each other.

And, the hooking contact portion 642 and the groove contact portion 662 are brought into contact with each other and are closely contacted while applying an external force to each other. As the hooking insert portion 632 and the first groove plane 652 are in close contact, and the hooking contact portion 642 and the groove contact portion 662 are in close contact, no passage for the flame to pass through is created, which has the effect of blocking the flame.

And, the hooking contact portion 642 is located parallel to the hooking insert portion 632 and remains in close contact with the groove contact portion 662, but does not remain in a hooking state. Thus, separation of the front end sandwich panel 60*a* and the rear end sandwich panel 60*b* is facilitated.

With respect to other configurations, the configurations in the embodiments of FIGS. 6 through 13 and FIG. 15 may be applied as is.

Although preferred embodiments of the present disclosure have been described in detail above, the scope of the present disclosure is not limited thereto, and various modifications and improvements by those skilled in the art utilizing the basic concepts of the present disclosure as defined by the following claims are also within the scope of the present disclosure.

The invention claimed is:

1. A sandwich panel comprising:

a core having a hooking end and a groove end; and a first exterior panel and a second exterior panel disposed on one side and an opposite side of the core respectively, wherein each of the first and second exterior panels includes:

a body in contact with the core, a hooking portion exhibiting elastic force toward a first direction perpendicular to a first surface of the body at a first end of the body, and a groove portion exhibiting elastic force toward a second direction perpendicular to the first surface of the body at a second end of the body and having an accommodating groove, wherein the hooking end includes a central protruding portion having a first cross-sectional area and step-down portions on both sides of the central protruding portion and the groove end includes an inflow protruding portion having a second cross-sectional area smaller than the first cross-sectional area and side protruding portions on both sides of the inflow protruding portion, wherein the accommodating groove is formed between the inflow protruding portion and the side protruding portions, wherein the side protruding portions protrude over the inflow protruding portion, wherein a height difference between the central protruding portion and the step-down portions is substantially equal to a height difference between the side protruding portions and the inflow protruding portion, wherein the hooking portion disposed at the hooking end of the core and the groove portion disposed at the groove end of the core, wherein an inflow groove is formed between the first exterior panel and the second exterior panel in front of the central protruding portion, wherein thermal energy applied to the body is transferred to the hooking portion and the groove portion, and the hooking portion and the groove portion are configured to be deformable by the thermal energy.

2. The sandwich panel of claim 1, wherein the hooking portion includes:

a hooking member bent multiple times at the first end of the body and protruding toward a direction away from the body, and a hooking elastic member slantly bent with a curvature toward the body at the hooking member and is configured to be deformable by the transferred thermal energy.

3. The sandwich panel of claim 2, wherein the hooking elastic member includes:

a hooking curvature portion connected to the hooking member and formed in a semicircular shape, and a hooking contact portion protruding toward the core at the hooking curvature portion, wherein an end of the hooking contact portion is spaced apart from the hooking member.

4. The sandwich panel of claim 3, wherein the hooking contact portion is slantly protruding toward the hooking member.

5. The sandwich panel of claim 1, wherein the groove portion includes:

a groove member bent multiple times at the second end of the body to form the accommodating groove, and a groove elastic member slantly bent with a curvature toward the accommodating groove at the groove member and is configured to be deformable by the transferred thermal energy.

6. The sandwich panel of claim 5, wherein the groove elastic member includes:

a groove curvature portion connected to the groove member and formed by bending toward the accommodating groove in a semicircular shape, and a groove contact portion protruding toward a circumferential direction of the accommodating groove at the groove curvature portion, wherein an end of the groove contact portion is spaced apart from a bottom of the accommodating groove.

7. The sandwich panel of claim 6, wherein the groove contact portion is slantly protruding toward a circumference of the accommodating groove.

8. The sandwich panel of claim 1, wherein the body, the hooking portion and the groove portion are formed from a metal coil having a width of 1,070 mm.

9. The sandwich panel of claim 1, wherein the hooking portion includes:

a hooking member bent multiple times at the first end of the body and protruding toward a direction away from the body, and a hooking elastic member slantly bent with a curvature toward the body at the hooking member, wherein the groove portion includes a groove member bent at the second end of the body to form the accommodating groove.

10. The sandwich panel of claim 9, wherein the body, the hooking portion and the groove portion are formed from a metal coil having a width of 1,040 mm.

11. The sandwich panel of claim 1, wherein the first direction is the direction away from the first surface of the body, and the second direction is the direction toward the first surface of the body.

12. A building structure comprising a plurality of the sandwich panels, wherein each of the sandwich panels comprise:

a core having a hooking end and a groove end; and a first exterior panel and a second exterior panel disposed on one side and an opposite side of the core respectively, wherein each of the first and second exterior panels includes: a body in contact with the core, a hooking portion exhibiting elastic force toward a first direction perpendicular to a first surface of the body at a first end of the body, and a groove portion exhibiting elastic force toward a second direction perpendicular to the first surface of the body at a second end of the body and having an accommodating groove, wherein the hooking end includes a central protruding portion having a first cross-sectional area and step-down portions on both sides of the central protruding portion and the groove end includes an inflow protruding portion having a second cross-sectional area smaller than the first cross-sectional area and side protruding portions on both sides of the inflow protruding portion, wherein the accommodating groove is formed between the inflow protruding portion and the side protruding portions, wherein the side protruding portions protrude over the inflow protruding portion, wherein a height difference between the central protruding portion and the step-down portions is substantially equal to a height difference between the side protruding portions and the inflow protruding portion, wherein the hooking portion disposed at the hooking end of the core and the groove portion disposed at the groove end of the core, wherein an inflow groove is formed between the first exterior panel and the second exterior panel in front of the central protruding portion, wherein the hooking portion includes: a hooking member bent multiple times at the first end of the body and protruding toward a direction away from the body, and a hooking elastic member slantly bent with a curvature toward the body at the hooking member and is configured to be deformable by the transferred thermal energy, wherein the hooking elastic member includes:

a hooking curvature portion connected to the hooking member and formed in a semicircular shape, and a hooking contact portion protruding toward the core at the hooking curvature portion, wherein an end of the hooking contact portion is spaced apart from the hooking member, wherein the groove portion includes:

a groove member bent multiple times at the second end of the body to form the accommodating groove, and a groove elastic member slantly bent with a curvature toward the accommodating groove at the groove member and is configured to be deformable by the transferred thermal energy, wherein the groove elastic member includes: a groove curvature portion connected to the groove member and formed by bending toward the accommodating groove in a semicircular shape, and a groove contact portion protruding toward a circumferential direction of the accommodating groove at the groove curvature portion, wherein an end of the groove contact portion is spaced apart from a bottom of the accommodating groove, wherein the sandwich panels are arranged such that the inflow protruding portion of a first sandwich panel is inserted into the inflow groove of a second sandwich panel, wherein the hooking elastic member of the hooking portion is inserted into the accommodating groove so that the hooking contact portion of the hooking portion and the groove contact portion of the groove portion elastically contact each other, and wherein the hooking portion and the groove portion are configured to elastically contact each other more closely by deformation when thermal energy is applied, and the hooking portion and the groove portion comprise a material configured to be oxidized by the thermal energy so that oxygen between the first and second sandwich panels is reduced.

13. The building structure of claim 12, further comprising:

a blocking portion disposed at the groove portion and the hooking portion respectively, the blocking portion being configured to be deformed by flame so that the spread of the flame introduced between the first and second sandwich panels is retarded.

14. The building structure of claim 13, wherein the blocking portion includes a dilative intumescent sheet disposed around the groove contact portion and the hooking contact portion respectively, configured to be expanded by the flame to make the groove contact portion and hooking contact portion closely contact each other.

15. The building structure of claim 13, wherein the blocking portion includes a metal material configured to combine with oxygen by being oxidized by the flame.

16. The building structure claim 13, wherein the blocking portion includes a fire extinguishing pack filled with an extinguishing material configured to be opened by the flame introduced between the first and second sandwich panels to release the extinguishing material.

* * * * *